US006906476B1

(12) United States Patent
Beatenbough et al.

(10) Patent No.: US 6,906,476 B1
(45) Date of Patent: Jun. 14, 2005

(54) POWER CONTROL SYSTEM FOR REDUCING POWER TO LIGHTING SYSTEMS

(75) Inventors: Bryan Beatenbough, Anderson, SC (US); Ryan Haley, Hartwell, GA (US)

(73) Assignee: ASP Corporation, Hartwell, GA (US)

( * ) Notice: Subject to any disclaimer, the term of this patent is extended or adjusted under 35 U.S.C. 154(b) by 48 days.

(21) Appl. No.: 10/628,067

(22) Filed: Jul. 25, 2003

(51) Int. Cl.[7] ..... H05B 41/16

(52) U.S. Cl. ..... 315/276; 315/209 R; 363/126; 323/268

(58) Field of Search ..... 315/209 R, 219, 315/224, 276, 291, DIG. 5; 361/91; 363/44, 81, 126, 25, 133; 323/223, 268

(56) References Cited

U.S. PATENT DOCUMENTS

| | | | | |
|---|---|---|---|---|
| 3,719,857 A | | 3/1973 | Sharp | 315/156 |
| 4,189,664 A | | 2/1980 | Hirschfeld | 315/297 |
| 4,289,993 A | | 9/1981 | Harper et al. | 315/311 |
| 4,431,948 A | | 2/1984 | Elder et al. | 315/276 |
| 4,642,525 A | * | 2/1987 | Widmayer | 315/219 |
| 5,113,333 A | * | 5/1992 | Ou | 363/25 |
| 5,426,579 A | * | 6/1995 | Paul et al. | 363/126 |
| 5,477,113 A | | 12/1995 | Christoffersson | 315/278 |
| 5,528,110 A | | 6/1996 | Archdekin | 315/276 |
| 6,114,842 A | | 9/2000 | Simpson et al. | 323/223 |
| 6,191,568 B1 | | 2/2001 | Poletti | 323/268 |

* cited by examiner

*Primary Examiner*—Don Wong
*Assistant Examiner*—Jimmy Vu
(74) *Attorney, Agent, or Firm*—McNair Law Firm, PA; Cort Flint

(57) ABSTRACT

A power control system is disclosed for controlling the power supplied to a lighting system and limiting power during time of peak demands and the like wherein the lighting system includes a power source and a lighting load connected to the power source. The control system comprises a main transformer having a first winding and a second winding, the first winding being connected between the power source and the lighting load. An autotransformer connected to the power source having a plurality of electrical transformer taps with prescribed voltage values. A plurality of solid-state tap switches is connected to the transformer taps and to the second winding of the main transformer to apply the prescribed voltage values across the second winding. A system controller has an input for receiving a voltage change signal representing a selected load voltage to be applied to the lighting load. The controller is connected to the tap switches for selectively closing one of the tap switches to produce said prescribed voltage value across the second winding of the main transformer whereby the selected load voltage is output across the first winding of the main transformer and applied to the lighting load without interruption of the lighting. A transient control circuit is connected across an output of the tap switches for dissipating transient currents during switching of tap switches.

26 Claims, 5 Drawing Sheets

POWER CONTROL SYSTEM FOR REDUCING POWER TO LIGHTING SYSTEMS

BACKGROUND OF THE INVENTION

This invention relates to a system for controlling the power delivered to HID and fluorescent light systems and, more particularly, to reducing the voltage to the lighting systems during periods of peak demand in the electrical power network and other prescribed periods of time to maximize efficiency and meet the guidelines imposed by regulatory parties.

In previous years, there have been periods of time in which the power available on certain electrical power grid networks is insufficient to supply the loads on the system. This is particularly true during the summer months when increased demands are made on electrical power systems by air conditioning and the like. In order to alleviate this problem, power companies have been required to mandate power limits on commercial and industrial customers. In particular, large grocery stores and retail complexes have been required to lower the power consumption of fluorescent lighting systems during the peak demand hours. Significant fines are placed on these customers if they exceed the power consumption mandated during the peak demand periods.

In the case of fluorescent and other commercial lighting systems, it is known to use autotransformers in the power supply to step the voltage up or down. It is known to manually change taps on an autotransformer to increase or decrease the voltage supply. However, to do this requires that the power system be shut down, physically unbolt the wire on the autotransformer, and move the wiring to new taps. The switching of these autotransformers is also typically done using mechanical relay contacts. Toroidal transformers have also been used in power control systems for controlling lighting using resistance or mechanical relay contact switching. Because there is a certain amount of energy in a transformer, current spikes occur during switching using mechanical contacts so that the contacts wear out and burn up beyond use. Therefore, the use of manual switching or mechanical contact relay switching in transformer systems has been an obstacle to the use of these systems. U.S. Pat. No. 6,191,568 B1 discloses a load voltage and power control supply system particularly suitable to street lighting systems. The power control system is able to act as a voltage stabilizer, as well as a control power reduction system, to operate spaced lighting from a single location. The controller uses a series of stepped down decreasing output levels between a high voltage and a low voltage to stabilize the autotransformer voltage.

U.S. Pat. No. 5,528,110 provides a voltage reduction apparatus designed to overcome the prior art problems of magnetic field flux, induced harmonic distortion, and heating wherein a bucking coil is wound in parallel to a common winding of the autotransformer to cancel any magnetic induced voltage in the common winding during switching.

U.S. Pat. No. 4,189,664 discloses a power control unit for automatically controlling the power consumption in a lighting load located between the power source and the load. The power control unit functions to reduce the voltage delivered to the load by applying one of a plurality of taps from an autotransformer to a lighting load wherein the switching unit is interposed between the input power and the load. U.S. Pat. No. 4,431,948 discloses a voltage reducing apparatus applied to a load utilizing an autotransformer and relay switching between the common winding and series winding of the autotransformer which avoids the problem of including a switching apparatus in the direct current path between the input power source and the load as disclosed in the former patent.

U.S. Pat. No. 5,477,113 discloses a dimmer for a halogen light which typically use a toroidal transformer to reduce house voltage to the 12 volts normally utilized by halogen bulbs. The transformer is provided with a variety of taps for stepping down the voltage by use of a stepping motor.

U.S. Pat. No. 3,719,857 discloses a dimmer for fluorescent, ultraviolet, or other gas discharge lighting using a dimmer or blinking ballast transformer. The variable power system is controlled by an audio signal apparently to provide a visual lighting display synchronous with sound produced by a speaker driven by an amplifier.

While a number of solutions have been provided to the problems encountered in power reduction systems caused by autotransformers and mechanical switching, considerable attention still needs to be given to the problems. In particular, the provision of the power reduction systems for lighting and the like wherein the power reduction system can be incorporated with other sophisticated electronics such as those found in environmental control panels is a problem to which considerable attention need be given.

Accordingly, an objective of the present invention is to provide an improved power reduction system for HID and fluorescent systems to reduce the voltage in order to meet the limitations placed on power consumption during peak demand and other periods.

Another object of the present invention is to provide a power reduction system for limiting the power to lighting and other systems which is light in weight, as well as providing cooler, quieter, and more efficient operation.

Another object of the present invention is to provide an improved power reduction system for electrical loads, particularly fluorescent lighting and the like, wherein a solid-state switching circuit is employed with toroidal transformers to provide a range of selectable voltage levels to reduce harmful current transients inherent in such transformer systems.

SUMMARY OF THE INVENTION

The above objectives are accomplished according to the present invention by providing a power control system for controlling the power supplied to a lighting system and limiting power during time of peak demands and the like wherein the lighting system includes a power source and a lighting load connected to the power source. The control system comprises a main transformer having a first winding and a second winding, the first winding being connected between the power source and the lighting load. A solid-state switching circuit is connected between the power source and the second winding of the main transformer which includes a toroidal transformer connected to the power source having a plurality of electrical transformer taps having prescribed voltage values. A plurality of solid-state tap switches are connected to the transformer taps and to the second winding of the main transformer to apply one of the prescribed voltage values across the main transformer. A system controller having an input for receiving a change voltage signal representing a selected load voltage to be applied to the lighting load, is connected to the tap switches for selectively closing one of the tap switches to produce the prescribed voltage value across the second winding of the main transformer. In this manner, the selected load voltage is output across the first winding of the main transformer and applied to the lighting load without interruption of the lighting. In an advantageous aspect of the invention, a transient control circuit is connected across an output of the tap switches for dissipating transient currents and voltages during changing of the tap switches. The transient control circuit comprises a solid-state control switch and a resistor connected in series across the second winding of the main transformer. The transient control circuit includes a second solid-state control switch connected in series with the second winding of the main transformer and neutral to disconnect the main transformer under the control of a soft-start circuit.

The control sequences the switching of the tap switches and the transient control and soft-start circuits and to reduce transient currents during change of the tap switches in response to the controller receiving an input signal to change power to the lighting load. The controller may be programmed to include tap switch switching instructions for switching from a currently closed tap switch to a newly selected tap switch in response to the input signal. The programmed instructions include a routine of (1) control switch instructions for closing the first control switch upon receipt of a voltage change signal so that the resistor is placed across the second winding; (2) control switch instructions for opening the second control switch to disconnect the second coil of the main transformer from the power source after soft-starting conditions are satisfied; (3) tap switch instructions for opening the currently closed tap switch and closing the selected tap switch; and (4) control switch closing instructions closing the second control switch and opening instructions for opening the first control switch after the tap switches have been changed.

The system includes a visual display, and the computer program includes a routine for displaying the status of the power control system on the visual display. The programmed controller includes instructions for alerting an external device if the power control system has been in a high voltage mode for a prescribed period of time. The programmed controller also includes instructions for setting the power control system in the high voltage mode in the event load voltage drops below a prescribed low voltage for a prescribed period of time.

The first and second windings of the main transformer are wound such that a voltage impressed across the secondary winding will result in a reduced voltage at the output of the primary winding. The tap switches cause the voltage across the second winding of the main transformer to be progressively stepped up causing the voltage of the first winding to be stepped down correspondingly. The controller input includes a manual input for inputting a desired selected voltage corresponding to a programmed voltage produced by closure of one of the tap switches whereupon the controller causes the tap switch to close. The controller input includes a digital input for connection to a remote computer terminal for inputting the desired voltage from a remote location. The controller may also include a digital output for outputting the voltage status of the controller to a remote computer terminal

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
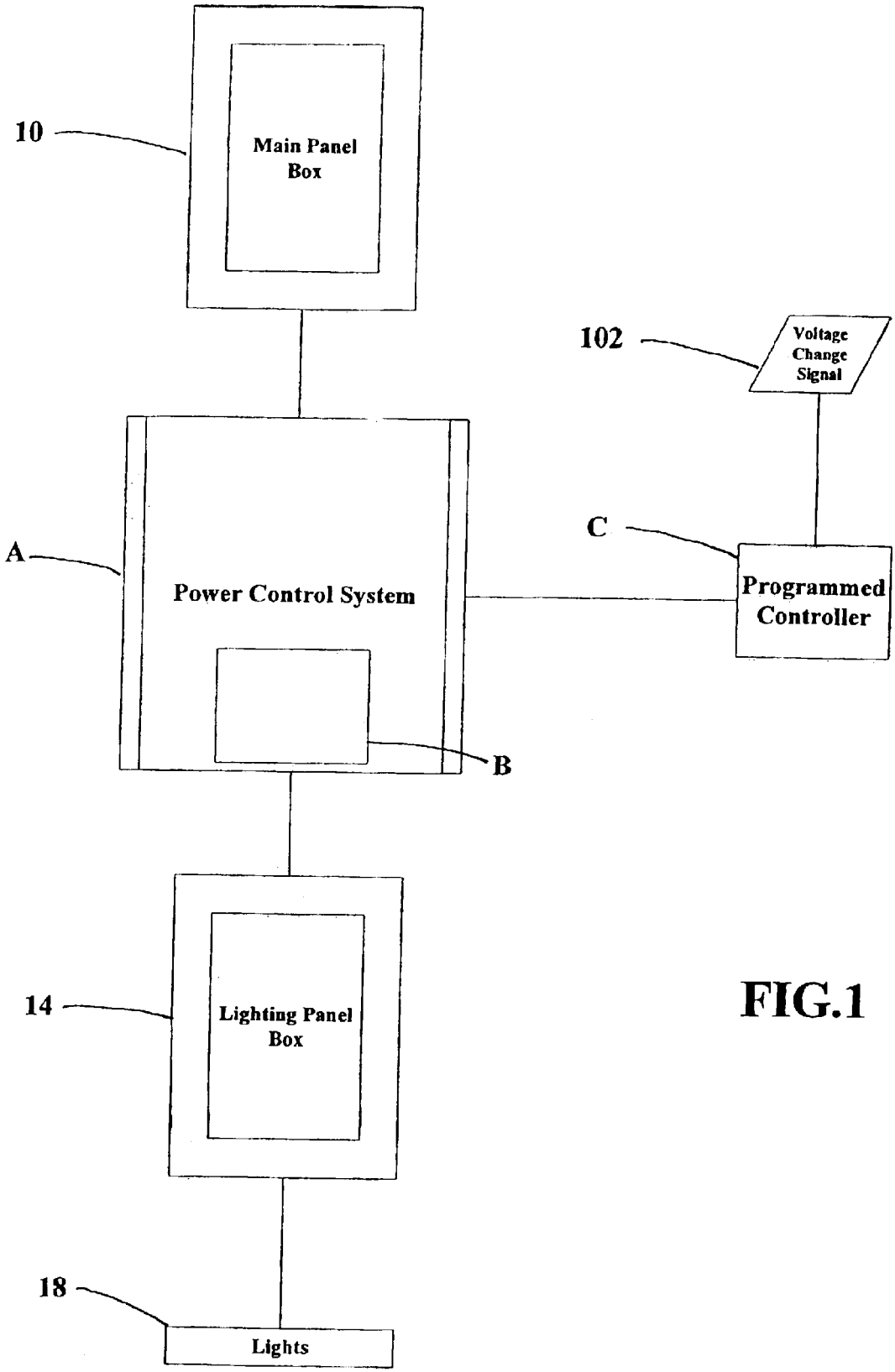
FIG. 1 is a schematic block diagram of a power control system for regulating a light system according to the invention.

Referring now to the drawings, the invention will now be described in more detail.

Figure 2:
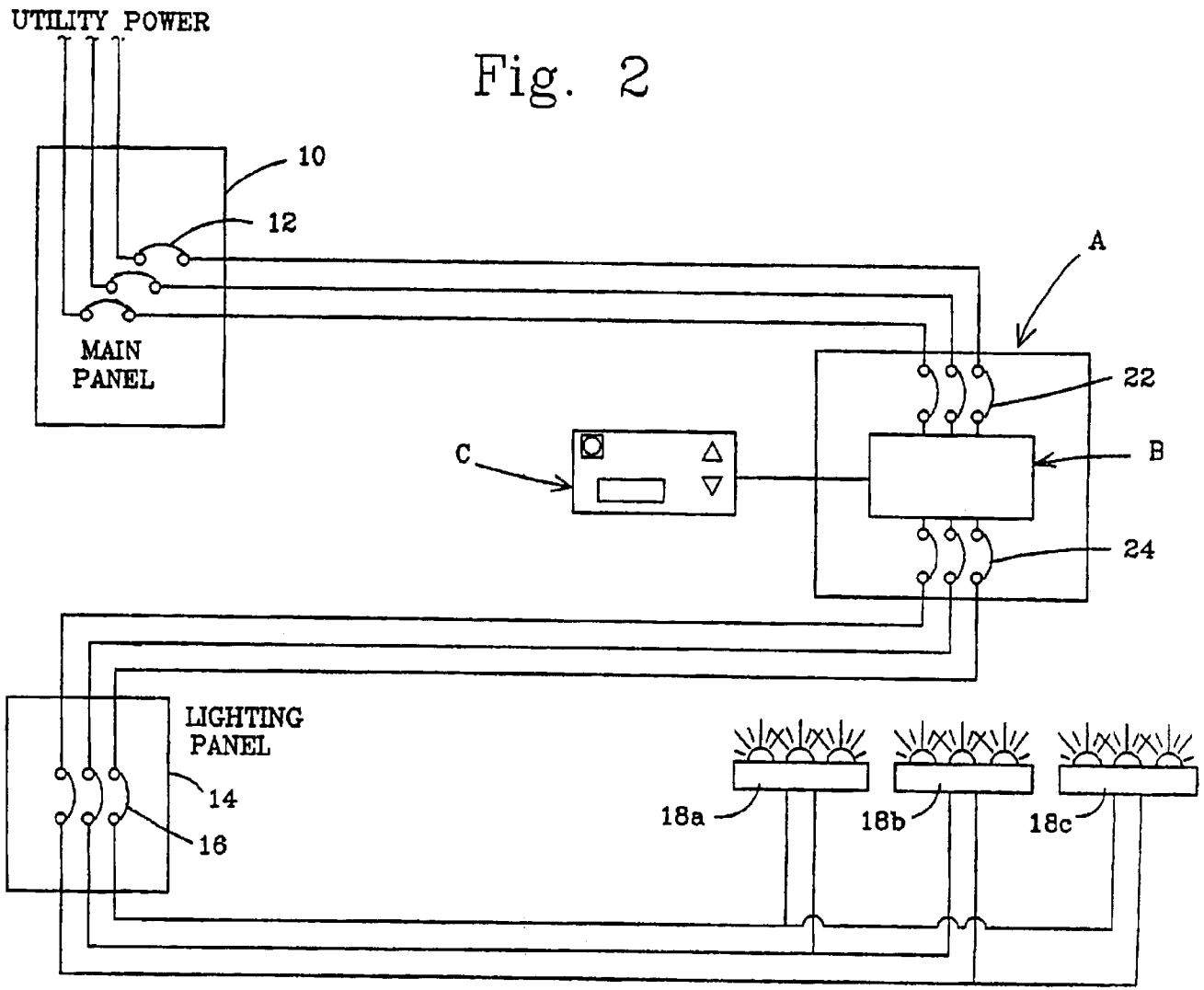
FIG. 2 is a schematic circuit diagram illustrating the solid-state power control system for reducing and regulating the voltage to a light system according to the invention.

Referring to FIGS. 1 and 2, a power control system, designated generally as A, is illustrated for controlling the power delivered from a main electrical panel 10 to a lighting system 18 via electrical lighting panel 14 used in industrial and commercial buildings, such as grocery stores, large retail stores, warehouses, and the like. A main power, such as utility power, is delivered to main distribution panel 10 through a series of circuit breakers 12 and delivered to a lighting distribution panel 14 (FIG. 2). The lighting panel is also provided with a series of circuit breakers 16 that deliver power to banks of lighting fixtures, such as 18*a*, 18*b*, and 18*c*.

In accordance with the present invention, power control system A includes a solid-state switching circuit B connected between the main distribution panel 12 and lighting distribution panel 14. There is a main system transformer, designated generally as T, having a first winding 34 connected in series with the lighting load 18. Connected to the solid-state switching circuit is a program logic controller, or other micro controller, designated generally as C. The solid-state switching circuit B includes a number of solid-state switching devices whose switching is controlled by controller C to apply one of a plurality of tap voltages across a second winding 36 of main transformer T to step voltage up or down as required.

Figure 3:
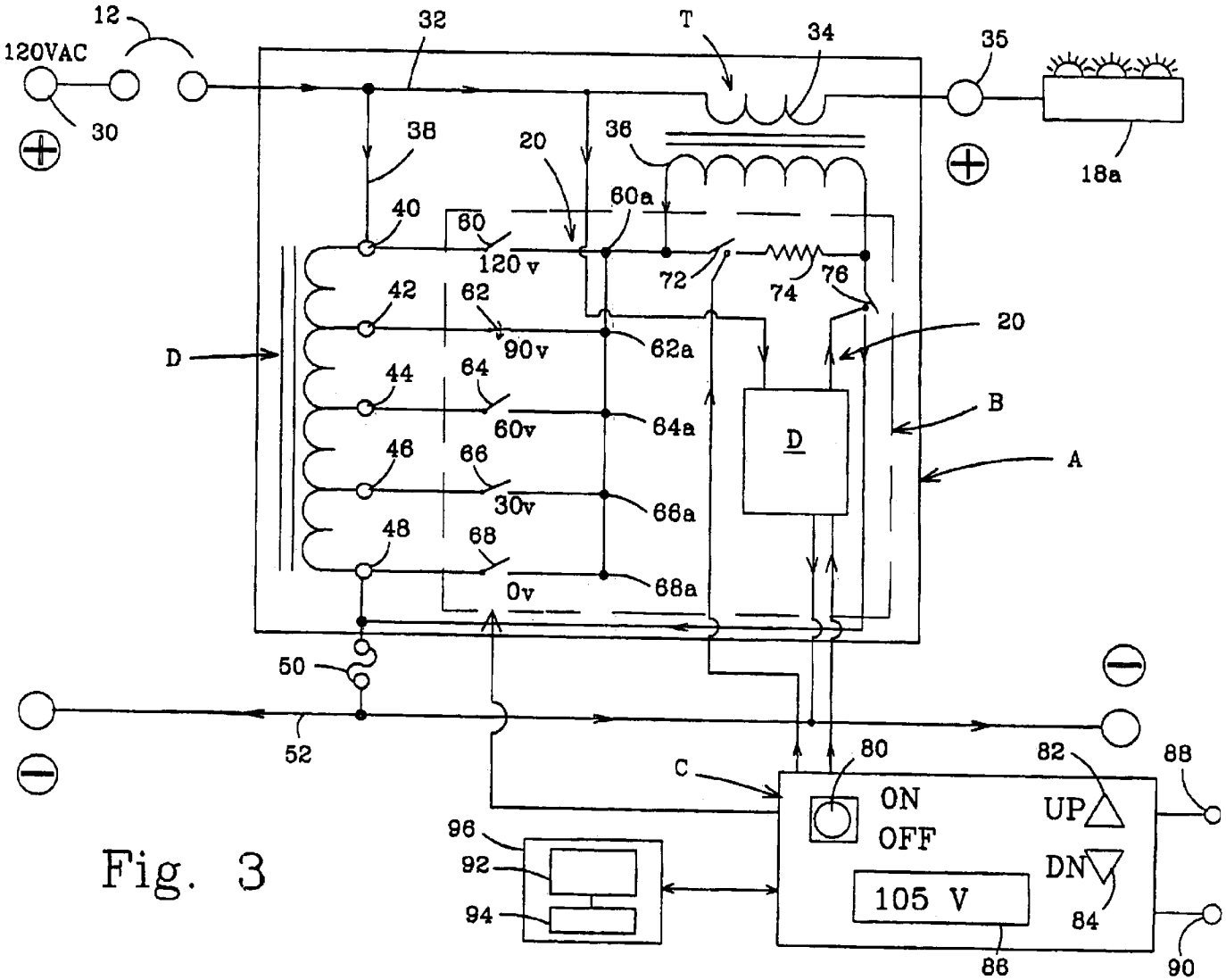
FIG. 3 is a detailed schematic diagram of a solid-state switching circuit for a power control system according to the invention for switching five tap voltages on a toroidal transformer to regulate power up and down on a light load according to the invention.

As can best be seen in FIG. 3, main power at 30 coming in from main distribution panel 10, through circuit breaker 12, is delivered along a line 32 to main transformer winding 34 connected in series with the circuit breaker. The voltage applied across first transformer 34 is applied to lighting fixture 18 by way of output at 35. Also connected to incoming power line 32 is a branch line 38 supplying power to a winding with multiple electrical taps 40, 42, 44, 46, and 48, of a toroidal autotransformer, designated generally as D. The electrical transformer taps 40–48 are also connected to solid-state switching circuit B. A fuse 50 connects the windings to neutral by way of neutral line 52. System controller C is connected to solid-state switching circuit 20 for controlling the switching routine of the circuit. Controller C may be any suitable program logic controller (PLC) or computer, such as a Millennium 2 micro controller available from Crouzet of Valence Cedex 9, France, part no. 88 950 051, programmed according to the teachings of the present invention.

Solid-state switching circuit B is illustrated schematically, including a number of solid-state top switching devices 60 through 68. Switching device 60 is in series with tap 40, switching device 62 is in series with tap 42, switching device 64 is in series with tap 44, switching device 66 is in series with tap 46, and switching device 68 is in series with tap 48. Solid-state switching-devices are selected one at a time by controller C. The outputs 60*a*–68*a* of the solid-state switching devices are connected in series with second winding 36, which is a buck winding of main transformer T. The second buck winding is coupled with first winding 34 of the main transformer connected to the lighting system. Also connected across second winding 34 is a transient control circuit, designated generally as 20, that includes a solid-state control switch 72, and a resistor 74. A second solid-state control switch 76 is connected in series with the coil and is controlled by the programmed controller via a soft-start circuit D included in the anti-transient circuit. In the illustrated transient control circuit 20, the circuit elements 72, 74, and 76 are utilized to control the switching routine and reduce transient currents when electronic switching devices 60–68 are changed, as will be more fully explained hereinafter. Any suitable solid-state switches may be used for the solid-state switches referred to herein, such to as solid-state relays available from Crydon Corporation of San Diego, Calif., part no. D2440D. Soft-start circuit 20 synchronizes operation of second control switch 76.

In the illustrated embodiment, programmed controller C has a voltage up button 82, and a voltage down button 84. The up and down buttons are for selecting a desired voltage output to lighting systems 18*a*, 18*b*, and 18*c*. A visual display 86 indicates the selected load voltage. In accordance with the present invention, five different voltage levels are provided by switching circuit B and programmed into controller C. For example, solid-state switch 60 causes a 100 volt output to the lighting system, switch 62 causes a 105 volt output to the lighting system, switching device 64 causes a 110 voltage output to the lighting system, switching device 66 causes a 115 volt output to the light system, and switching device 68 causes a 120 volt output to the light system. A respective switch is closed, the resulting voltage is applied across the main power line 32 to the lighting system. Windings 34 and 36 are wound so that 120 volts from tap 40 placed across buck winding 36 will generate 20 volts on winding 34. The 20 volts produced at winding 34 is opposed to the voltage on power line 32 so that the resultant voltage output at 35 is 100 volts. Likewise, closure of switching device 62 will place a voltage from tap 42 across winding 36 of 90 volts, producing 15 volts across winding 34 and a resulting power output of 105 volts to the lighting system. Closure of switch 64 place the voltage from tap 44 across buck winding 36 of 60 volts placing 10 volts across winding 34 and 110 volts at output 35. Closure of switching device 66 places a voltage of 30 volts from tap 46 across winding 36 and 5 volts across winding 34 resulting in 115 volts output at 35 to the lighting system. Finally, closing of switching device 68 places a voltage from tap 48 across winding 36 of 0 volts placing 0 volts across winding 34 and a resulting voltage of 120 volts at output 35 delivered to the lighting system. While programmed controller C may be operated manually to select the desired load voltage in the form of a voltage reduction or increase across the main power line to the lighting system, this may also be done in a programmed manner by either programming controller C or by inputting a desired programming through digital input 88 of controller C.

A voltage change request received at input 88 in the form of voltage change signal 102. The voltage change signal may be manually input or may be transmitted from a conventional environmental control panel wherein the times that the solid-state switching devices are to switch to selected load voltages are programmed to provide the desired load voltage to the lighting systems in accordance with light sensors, peak load time period requirements, and the like. Likewise, a digital output may be provided at 90 so that the system may be monitored remotely.

A program code 92 having instructions 94 for controlling voltage switching routine is stored in a memory 96 in system controller C. The programmed controller controls the switching of the solid-state tap switches 60–68, and the switching routine of control switches 72 and 76, including times and sequence. This is done by controlling first control switch 72 directly, and controlling second control switch 74 by means of soft-start circuit D; as explained below. The program includes routines to control the opening and closing of the solid-state switching devices in a manner to protect the devices and system against transient currents and voltages, according to the operations, sequences, and logic disclosed herein as will be readily app apparent and within the purview of one skilled in the automatic control and programming art. As can best be seen in the logic diagram of FIG. 4, the switching routine will be described. At 102, an up and down button is pressed, or signal received, to input a voltage change signal and switch the transformer taps. At 100, the voltage change instructions in the programmed controller initiates a switching routine which includes instructions for closing solid-state switch 72 and placing resistor 74 across second winding 36. At the same time, a signal 79 is sent to start the soft-start circuit (FIG. 5), open solid-state switch 76 under the control of a soft-start circuit D. A signal from circuit D to switch 76 removes the second winding from the main power line. At 106, the instructions next switch the transformer taps, i.e., open switch 60 and close switch 62, as illustrated in FIG. 3. The program then calls for instructions reversing the operations described above in the reverse order in which they were initiated. At 108, the program calls for circuit D to close solid-state switch 76 and connect winding 36 across the power line under the control of soft-start circuit D, and then at 110, controller C switches solid-state switch 72 open to remove the resistor from the across the winding.

Figure 4:
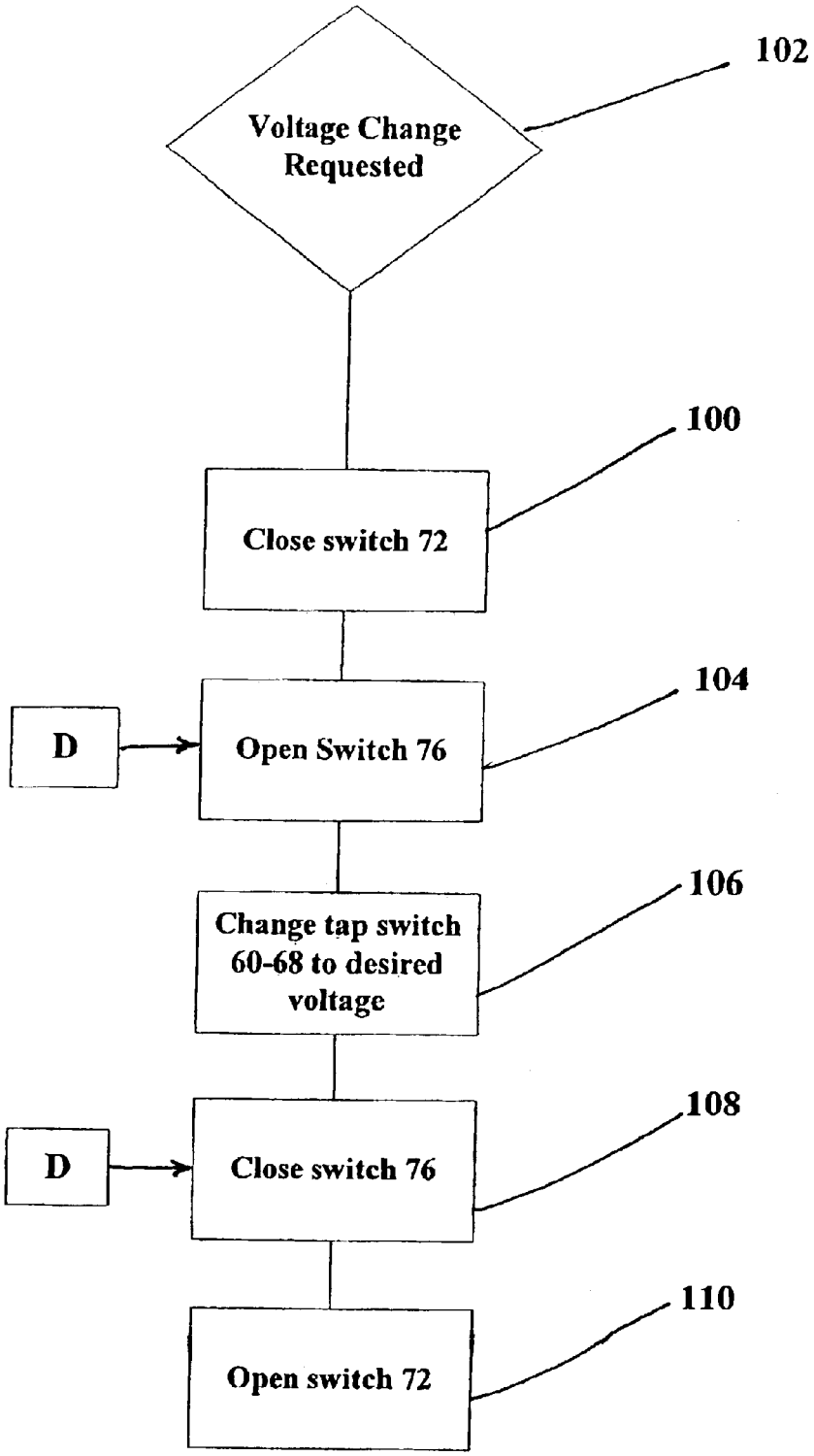
FIG. 4 is a flow chart of computer instructions for controlling the switching of the solid-state tap switches of the invention to control transients during switching.
Figure 5:
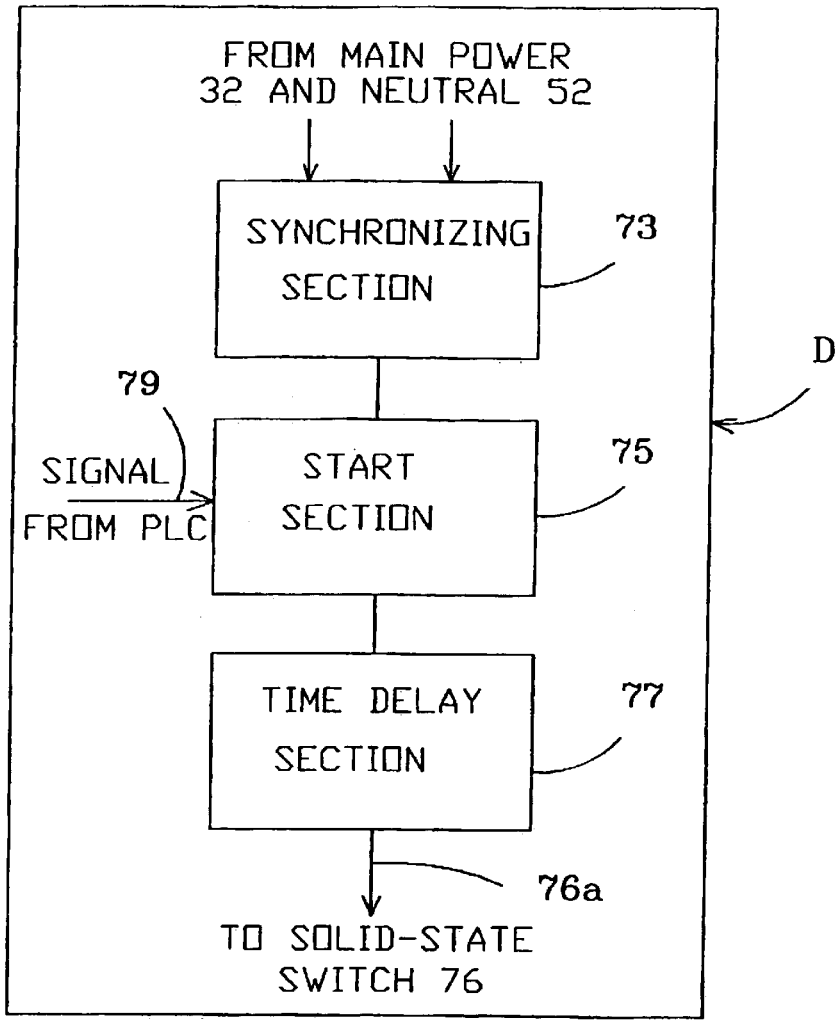
FIG. 5 is a schematic diagram of a solid-state soft circuit according to the present invention.

As can best be seen in FIG. 4, controller C is programmed with switching routine instructions including (1) control switch instructions for closing first control switch 72 upon receipt of a switch change signal 102 so that resistor 74 is placed across second winding 36; (2) control switch instructions 104 for opening second control switch 76 to disconnect the second coil of the main transformer from the power source; (3) tap switch instructions 106 for opening the currently closed tap switch and closing the selected tap switch corresponding to the selected load voltage; and (4) control switch closing instructions 108 closing second control switch 76 and opening instructions 110 for opening first control switch 72 after the tap switches are changed.

Anti-transient circuit 20 is controlled by the PLC, and solid-state switch 72 is switched directly by the PLC. The PLC sends a signal 79 to soft-start circuit D to the synchronizing circuit to open/close switch 76. Circuit D uses a soft-start technique, which slowly opens/closes switch 76 over a period of time to avoid current transients. Circuit D synchronizes the opening/closing of switch 76 with the incoming voltage waveform to ensure that the switching is done at points in the waveform that minimize transients. The circuit also uses a slight time delay to take into account the phase shift caused by the inductance of the second winding of the transformer. Without this delay, the transients may still exist. For the above purposes, soft-start circuit D includes of three major sections, a synchronizing section 73, a soft-start section 75, and a time delay section 77. Synchronizing section 73 is connected across the main power line 32 and the neutral line 52 to synchronize the switching of solid-state switch 76 with the incoming power sine wave. Start section 75 slowly turns the solid-state switch 76 on or off over a period of time to minimize any current transients. Time delay section 77 delays the slow to switching of the solid-state switch to ensure that the switching does not take place too early in the sine wave. Without section 77, there is a possibility that the solid-state switch could turn on at random times, causing current transients. Soft-start circuit D is activated by the PLC at 79. When the PLC gives solid-state switch 76 a signal 79 to open or close, this signal is first intercepted by start section 75 and the start section handles the actual opening or closing of solid-state switch 76 via time delay section 77 which generates switch signal 76*a*.

The programmed controller may also include alarm instructions for alerting an external device if the power control system has been in a high voltage mode for a prescribed period of time; and instructions for setting said power control system in the high voltage mode in the event load voltage drops below a prescribed low voltage for a prescribed period of time.

While a preferred embodiment of the invention has been described using specific terms, such description is for illustrative purposes only, and it is to be understood that changes and variations may be made without departing from the spirit or scope of the following claims.

What is claimed is:

1. A power control system for controlling the power supplied to a lighting system and limiting power during time of peak demands and the like wherein the lighting system includes a power source and a lighting load connected to the power source, said control system comprising:

(a) a main transformer having a first winding and a second winding, said first winding being connected between said power source and said lighting load;

(b) a solid-state switching circuit connected between said power source and said second winding of said main transformer which includes:

(i) a toroidal transformer connected to said power source having a plurality of electrical transformer taps wherein each tap has a prescribed voltage value, and (ii) a plurality of solid-state tap switches connected to said transformer taps and to said second winding of said main transformer to apply one of said prescribed voltage values across said main transformer; and (c) a controller having an input for receiving a voltage change signal representing a selected load voltage to be applied to said lighting load, and said controller being connected to said tap switches for selectively closing one of said tap switches to produce said prescribed voltage value across said second winding of said main transformer whereby said selected load voltage is output across said first winding of said main transformer and applied to said lighting load without interruption of the lighting.

2. The system of claim 1 including a transient control circuit connected across an output of said tap switches for dissipating transient currents during changing of said tap switches.

3. The system of claim 2 wherein said transient control circuit comprises a solid-state switch and a resistor connected in series across said second winding of said main transformer, and a soft-start circuit for disconnecting the transformer from the main power during switching of said tap switches.

4. The system of claim 3 wherein said transient control circuit includes a second solid-state switch connected in series with said second winding of said main transformer and neutral; and said soft-start circuit including a synchronizing circuit for synchronizing the switching of said second control switch to disconnect said transformer with the changing of said tap switches.

5. The system of claim 4 wherein said programmed controller includes a program for sequencing the switching of said tap switches and controlling said transient control circuit to reduce transients during change of said tap switches in response to said controller receiving an input signal to change voltage to said lighting load.

6. The system of claim 5 wherein said controller program includes tap switch switching instructions for switching from a currently closed tap switch to a newly selected tap switch in response to said input signal comprising:

control switch instructions for closing said first control switch upon receipt of a switch change signal so that said resistor is placed across said second winding;

control switch instructions for opening said second control switch to disconnect said second coil of said main transformer from said power source;

tap switch instructions for opening the currently closed tap switch and closing said selected tap switch; and control switch closing instructions closing said second control switch and opening instructions for opening said first control switch.

7. The system of claim 5 wherein said system includes a visual display, and said controller program includes a routine for displaying the status of said power control system on said visual display.

8. The system of claim 5 wherein said controller program includes instructions for alerting an external device if the power control system has been in a high voltage mode for a prescribed period of time.

9. The system of claim 8 wherein said computer program includes instructions for setting said power control system in the high voltage mode in the event load voltage drops below a prescribed low voltage for a prescribed period of time.

10. The system of claim 1 wherein said solid-state tap switches are connected in parallel with one another and in series with said transformer taps and said second coil of said main transformer.

11. The system of claim 10 wherein closing of said tap switches cause the voltage across said second winding of said main transformer to be progressively stepped up causing the voltage of said first winding to be stepped down correspondingly.

12. The system of claim 1 wherein said controller input includes a manual input for receiving a desired selected voltage whereupon said controller causes said tap switch to close.

13. The system of claim 1 wherein said controller input includes a digital input for connection to a remote device for inputting the desired voltage from a remote location.

14. The system of claim 13 wherein said controller includes a digital output for outputting the voltage setting of said controller to said remote device.

15. A power control system for controlling the power supplied to a lighting system and limiting power during time of peak demands and the like wherein the lighting system includes a power source and a lighting load connected to the power source, said control system comprising:

a main transformer having a first winding and a second winding, said first winding being connected between said power source and said lighting load;

an autotransformer connected to said power source having a plurality of electrical transformer taps having prescribed voltage values, a plurality of solid-state tap switches connected to said transformer taps and to said second winding of said main transformer to apply said prescribed voltage values across said second winding; and a system controller having an input for receiving a voltage change signal representing a selected load voltage to be applied to said lighting load;

said controller being connected to said tap switches for selectively closing one of said tap switches to produce said prescribed voltage value across said second winding of said main transformer whereby said selected load voltage is output across said first winding of said main transformer and applied to said lighting load without interruption of the lighting; and a transient control circuit connected across an output of said tap switches for dissipating transient currents during switching said tap switches.

16. The system of claim 15 wherein said transient control circuit comprises a first solid-state switch and a resistor connected in series across said second winding of said main transformer; and a second solid-state switch connected in series with said second winding of said main transformer and neutral.

17. The system of claim 15 wherein said controller includes a computer program for sequencing the switching of said tap switches and controlling said transient control circuit to reduce transient voltages during change of said tap switches in response to said controller receiving an input signal to change power to said lighting load.

18. The system of claim 17 wherein said controller program includes tap switch switching instructions for switching from a currently closed tap switch to a newly selected tap switch in response to said input signal comprising:

control switch instructions for closing said first control switch upon receipt of a switch change signal so that said resistor is placed across said second winding;

control switch instructions for opening said second control switch to disconnect said second coil of said main transformer from said power source;

tap switch instructions for opening the currently closed tap switch and closing said selected tap switch; and control switch closing instructions closing said second control switch and opening instructions for opening said first control switch.

19. The system of claim 15 wherein first and second windings of said main transformer are out of phase with each other.

20. The system of claim 19 wherein closing of said tap switches cause the voltage across said second winding of said main transformer to be progressively stepped up causing the voltage of said first winding to be stepped down correspondingly.

21. A power control system for controlling the power supplied to a lighting system and limiting power during time of peak demands and the like wherein the lighting system includes a power source and a lighting load connected to the power source, said control system comprising:

a main transformer having a first winding and a second winding, said first winding being connected between said power source and said lighting load;

a toroidal transformer connected to said power source having a plurality of electrical transformer taps with prescribed voltage values;

a plurality of solid-state tap switches connected to said transformer taps and to said second winding of said main transformer to apply one of said prescribed voltage values across said main transformer;

a programmed controller having an input for receiving a voltage change input signal representing a desired selected load voltage to be applied to said lighting load; and said controller being connected to said tap switches for selectively closing one of said tap switches to apply said prescribed voltage value across said second winding of said main transformer whereby said selected load voltage is output across said first winding of said main transformer and applied to said lighting load without interruption of the lighting; and said controller sequencing the switching of said tap switches in response to a voltage change input signal to change the power applied to said lighting load; and a transient control circuit for synchronizing the disconnection of said main transformer from the main power during changing of said tap switches.

22. The system of claim 21 including a transient control circuit connected across an output of said tap switches for dissipating transient currents during changing of said tap switches.

23. The system of claim 22 wherein said transient control circuit comprises a first solid-state control switch and a resistor connected in series across said second winding of said main transformer, and a second solid-state control switch connected in series with said second winding of said main transformer and neutral.

24. The system of claim 23 including a soft-start circuit for switching said second control switch in accordance with an incoming voltage waveform to ensure that switching is done at a point on the waveform that minimizes transients.

25. The system of claim 23 wherein said controller program is programmed for switching from a currently closed tap switch to a newly selected tap switch in response to said input signal comprising: closing said first control switch upon receipt of a switch change signal so that said resistor is placed across said second winding; opening said second control switch to disconnect said second coil of said main transformer from said power source; opening the currently closed tap switch and closing said selected tap switch; closing said second control switch and opening instructions for opening said first control switch.

26. The system of claim 21 wherein said solid-state tap switches are connected in parallel with one another and in series with said transformer taps and said second coil of said main transformer.

* * * * *